US008033278B2

(12) United States Patent
Kitajima et al.

(10) Patent No.: US 8,033,278 B2
(45) Date of Patent: Oct. 11, 2011

(54) SEGMENTED GRINDING WHEEL AND MANUFACTURING METHOD THEREFOR

(75) Inventors: Masato Kitajima, Hekinan (JP); Kunihiko Unno, Hamamatsu (JP); Hiroshi Takehara, Kasugai (JP); Takuma Kono, Okazaki (JP); Shinji Soma, Handa (JP)

(73) Assignees: Toyoda Van Moppes Ltd., Okazaki-shi (JP); JTEKT Corporation, Osaka-shi (JP)

( * ) Notice: Subject to any disclaimer, the term of this patent is extended or adjusted under 35 U.S.C. 154(b) by 624 days.

(21) Appl. No.: 12/096,921

(22) PCT Filed: Nov. 13, 2006

(86) PCT No.: PCT/JP2006/322549

§ 371 (c)(1), (2), (4) Date: Jun. 11, 2008

(87) PCT Pub. No.: WO2007/077675

PCT Pub. Date: Jul. 12, 2007

(65) Prior Publication Data

US 2010/0261420 A1 Oct. 14, 2010

(30) Foreign Application Priority Data

Dec. 28, 2005 (JP) ..... 2005-380087

(51) Int. Cl.
*B24D 5/06* (2006.01)

(52) U.S. Cl. ..... 125/15; 451/542

(58) Field of Classification Search ..... 451/541, 451/542, 543; 51/293, 297, 298; 125/15
See application file for complete search history.

(56) References Cited

U.S. PATENT DOCUMENTS

2002/0119742 A1 8/2002 Nakagawa et al.

FOREIGN PATENT DOCUMENTS

| | | |
|---|---|---|
| EP | 0 997 231 A2 | 5/2000 |
| EP | 0 997 231 A3 | 5/2000 |
| JP | 52 160184 | 12/1977 |
| JP | 5 96471 | 4/1993 |
| JP | 6 5862 | 1/1994 |
| JP | 2000 226568 | 8/2000 |
| JP | 2000 280178 | 10/2000 |
| JP | 2003 300165 | 10/2003 |
| JP | 2004-034246 | 2/2004 |

OTHER PUBLICATIONS

Office Action issued Nov. 17, 2010, in State Intellectual Property Office of People's Republic of China, Application No. 200680048010.6 (with English Translation).

*Primary Examiner* — Robert Rose

(74) *Attorney, Agent, or Firm* — Oblon, Spivak, McClelland, Maier & Neustadt, L.L.P.

(57) ABSTRACT

A plurality of segmented chips are reinforced by applying an adhesive to the circumferentially opposite end portions thereof, and the adjoining segmented chips adjoining in the circumferential direction are adhered to the circumferential surface of a disc-like core with the adhesives at the circumferentially opposite end portions being not jointed with each other. Thus, the segmented chips can be prevented from being loaded with an unnatural force even when the disc-like core with the segmented chips adhered thereto expands and contracts radially due to thermal expansion and thermal contract. Thereby, expansion and contraction of the disc-like core do not impose a compression stress or the like on adhesives situated between adjoining segmented chips.

8 Claims, 2 Drawing Sheets

SEGMENTED GRINDING WHEEL AND MANUFACTURING METHOD THEREFOR

TECHNOLOGICAL FIELD

The present invention relates to a segmented grinding wheel and a manufacturing method therefor wherein a plurality of segmented chips are adhered to the circumferential surface of a disc-like core.

BACKGROUND ART

As described in Patent Document 1 for example, there has been known a segmented grinding wheel wherein a plurality of segmented chips each formed to a predetermined shape by bonding super-abrasive grains such as CBN abrasive grains or the like with vitrified bond are adhered to the circumferential surface of a disc-like core. In the segmented grinding wheel of this kind, after being press-formed and burned, the plurality of segmented chips are arranged on the circumferential surface of a disc-like core made of steel with slight clearances therebetween in the circumferential direction and adhered thereto with a bonding material.

By the way, places for adhesion in the prior art segmented grinding wheel are an internal portion and opposite end portions of each segmented chip, wherein each segmented chip is bonded at its internal portion to the circumferential surface of the disc-like core and is bonded at its opposite end portions to segmented chips next thereto. Then, segmented chips which adjoin at the opposite end portions are mutually jointed to preclude abnormal abrasion of the grinding wheel which would otherwise occur if clearances were provided between the segmented chips.

In segmented grinding wheels, generally, a thermosetting resin such as phenol resin, epoxy resin or the like are used as adhesive. After segmented chips are adhered to the circumferential surface of a disc-like core, the segmented grinding wheel is put into a drying furnace and is dried for a predetermined period of time at a predetermined temperature to set the adhesive.

Patent Document 1: Japanese unexamined, published patent application No. 2003-300165 (paragraph 0024, FIG. 2)

DISCLOSURE OF THE INVENTION

Problem to be Solved by the Invention

In the aforementioned segmented grinding wheel, since heat is applied to set the adhesive, the disc-like core made of steel thermally expands by the application of heat. However, the thermal expansion quantity of the segmented chips bonded with vitrified bond is small in comparison with the thermal expansion quantity of the disc-like core. Thus, the thermal expansion of the disc-like core brought about by the heat application to the adhesive causes the segmented chips to be displaced radially outward to increase the clearances between the adjoining segmented chips, in which state the setting of the adhesive proceeds.

As a consequence, when returned again to the normal temperature after the setting of the adhesive, the thermally expanded disc-like core contracts, and this causes a compression force to be exerted on the adhesive portions between the adjoining segmented chips, whereby an unnatural stress remains being imposed on the segmented chips.

The present invention has been made to solve the foregoing drawbacks and is to provide a segmented grinding wheel and a manufacturing method therefor in which any compression stress or the like does not act on adhesives situated between adjoining segmented chips in spite of the expansion and contraction of a disc-like core.

Measures for Solving the Problem

For solving the problem, to a first aspect of the invention includes a segmented grinding wheel of the construction that a plurality of segmented chips each configured by bonding abrasive grains with a bond are adhered to the circumferential surface of a disc-like core, wherein the plurality of segmented chips are reinforced by applying adhesive made of a thermosetting resin to circumferentially opposite end portions thereof and wherein the segmented chips adjoining in a circumferential direction are adhered to the circumferential surface of the disc-like core with the adhesives at the circumferentially opposite end portions being not bonded with each other.

A second aspect of the invention includes in the first aspect of the invention, the bond is made of a vitrified bond.

A third aspect of the invention includes a method for manufacturing a segmented grinding wheel of the construction that a plurality of segmented chips each configured by bonding abrasive grains with a bond are adhered to the circumferential surface of a disc-like core, the method comprising the steps of filling a mold with granular material including abrasive grains, performing a press-forming and a burning to form a plurality of segmented chips, applying adhesive made of a thermosetting resin to circumferentially opposite end portions of the segmented chips, and after setting the adhesives at the circumferentially opposite end portions, adhering the plurality of segmented chips to the circumferential surface of the disc-like core.

EFFECTS OF THE INVENTION

With the construction of the segmented grinding wheel according to the first aspect of the invention, the plurality of segmented chips are reinforced by having the adhesives applied to the circumferentially opposite end portions thereof, and segmented chips adjoining in the circumferential direction are adhered to the disc-like core with the adhesives thereof being not jointed with each other. Thus, even when the disc-like core with the segmented chips adhered thereto expands and contracts in radial directions due to thermal expansion and contraction, because of the adjoining segmented chips being not jointed, it does not occur that the expansion and contraction of the disc-like core cause a compression stress to be imposed on the segmented chips and the adhesives which would otherwise join the adjoining segmented chips mutually, and therefore, an unnatural force can be prevented from being exerted on the segmented chips.

In addition, because the respective opposite end portions of the segmented chips are reinforced with the thermosetting resins (adhesives), the retention force can be enhanced of the abrasives grains residing in the neighborhood of the opposite end portions of the segmented chips. Thus, even in the presence of clearances between adjoining segmented chips, the segmented chips can be restricted from losing exact edges at the respective opposite end portions through grinding operations, and thus, it does not occur that the life of the segmented grinding wheel is shortened.

In the segmented grinding wheel according to the second aspect of the invention, since the bond which joins the abrasive grains comprises a vitrified bond, in addition to the advantage of claim 1, there is attained another advantage that the grinding wheel is excellent in a capability of discharging grinding chips, becomes sharp in cutting quality and is capable of grinding workpieces to fine surface roughness with a little wear amount thereof.

In the method for manufacturing a segmented grinding wheel according to the third aspect of the invention, the segmented grinding wheel is manufactured by applying adhesives made of a thermosetting resin to the respective opposite end portions in the circumferential direction of the segmented chips and after setting the adhesives, by adhering the plurality of segmented chips on the circumferential surface of the disc-like core. Therefore, after the adhesion of the segmented chips to the circumferential surface of the disc-like core, it is unnecessary to heat and set adhesives arranged between the segmented chips as is done in the prior art. Thus, it does not occur that a compression stress is exerted on the set adhesives when the segmented grinding wheel being manufactured is returned to the normal temperature after the setting of the adhesives.

DESCRIPTION OF REFERENCE SYMBOLS

10 . . . segmented grinding wheel, 11 . . . segmented chips, 12 . . . grinding layer, 13 . . . foundation layer, 14 . . . super-abrasive grains, 15 . . . vitrified bond, 20, 23 . . . adhesives, 21 . . . disc-like core, 21*a* . . . circumferential surface.

PREFERRED EMBODIMENT FOR PRACTICING THE INVENTION

Figure 1:
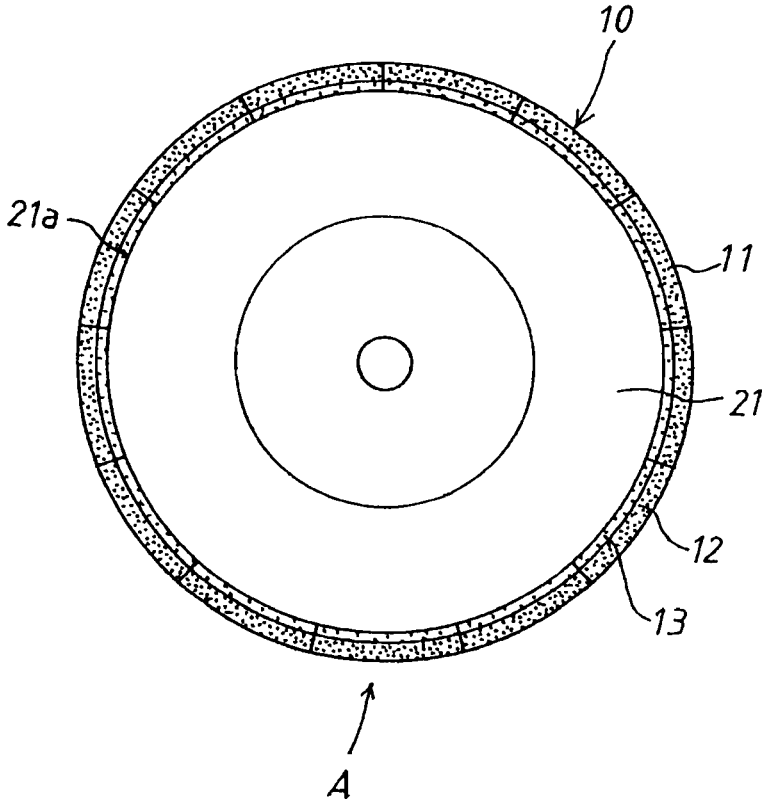
[FIG. 1] is an overall view of a segmented grinding wheel composed of a plurality of segmented chips showing an embodiment according to the present invention.

Hereafter, an embodiment of the present invention will be described with reference to the drawings. FIG. 1 shows a segmented grinding wheel 10 composed of a plurality of segmented chips 11 in a circumferential direction, and each segmented chip 11 of the segmented grinding wheel 10 takes the construction that a grinding layer 12 with super-abrasive grains bonded with a vitrified bond is formed on the outer surface side and that a foundation layer 13 not including super-abrasive grains is formed bodily to be piled up on the inner side of the grinding layer 12. The plurality of arc-shape segmented chips 11 each composed of the grinding layer 12 and the foundation layer 13 are arranged on the circumferential surface 21*a* of a disc-like core 21 made of iron, a titanium-base alloy, an aluminum-base alloy or the like at regular intervals in the circumferential direction and are adhered thereto with an adhesive which is interposed between the inner surfaces of the segmented chips 11 (the bottom surfaces of the foundation layers 13) and the circumferential surface 21*a* of the disc-like core 21, to constitute the segmented grinding wheel 10.

Figure 2:
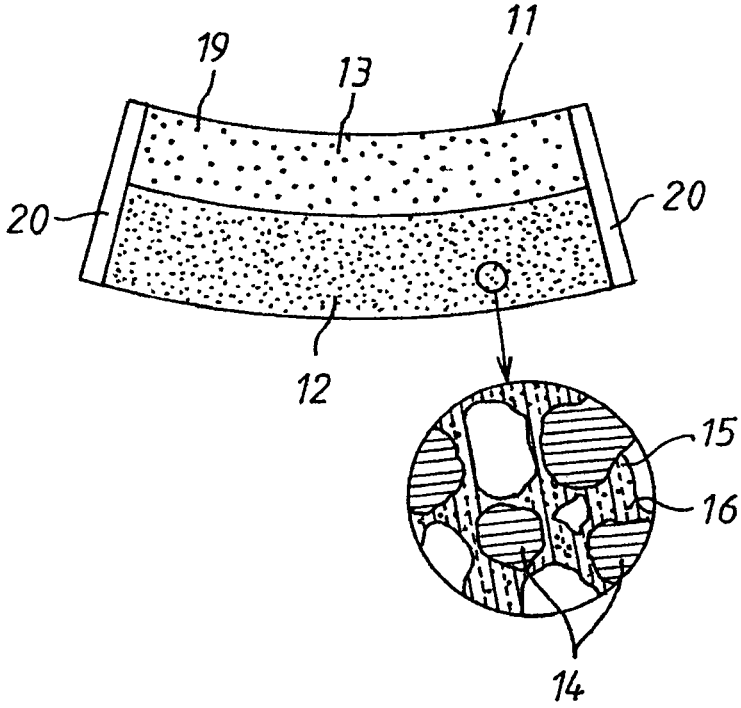
[FIG. 2] is a view showing a segmented chip.

FIG. 2 shows the arc-shape segmented chip 11. The grinding layer 12 is constituted by bonding super-abrasive grains 14 such as CBN, diamond or the like with a vitrified bond 15 to the thickness of 3 to 5 millimeters in a predetermined concentration. The vitrified bond 15 may include particles 16 of aluminum oxide ($Al_2O_3$) or the like mixed thereinto as aggregate, if need be. Further, the foundation layer 13 is constituted by bonding foundation particles 19 with the vitrified bond 15 to the thickness of 1 to 3 millimeters. Adhesives 20 made of a thermosetting resin are respectively applied to the opposite end portions of each segmented chip 11, and the super-abrasive grains 14 which are situated at the edges of the opposite end portions of each segmented chip 11 are reinforced with respective resin layers made of the adhesives 20, so that the retention strength of these super-abrasive grains 14 can be enhanced.

With the use of the vitrified bond 15, thanks to the property of pores being provided, the grinding wheel is excellent in a capability of discharging cutting chips and becomes sharp in cutting quality, so that it can be realized to grind workpieces to fine surface roughness with a little wear amount thereof. However, as the bonding material, resin bond, metal bond or the like may be used in addition to the vitrified bond 15.

Figure 3:
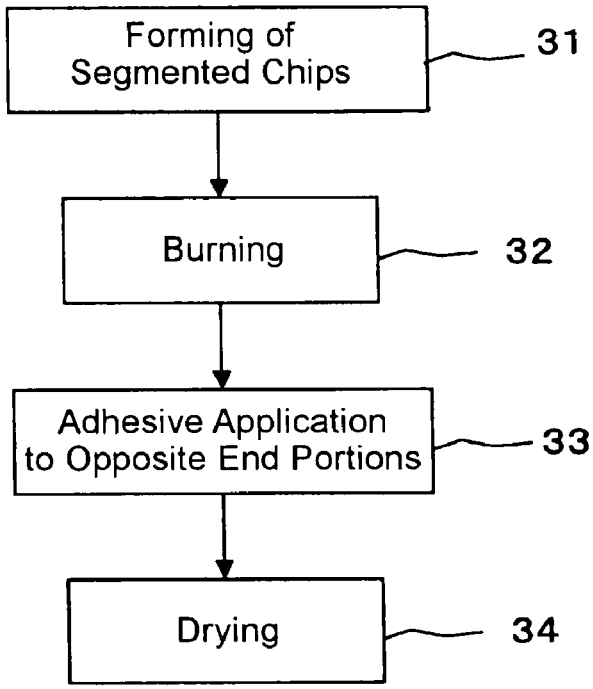
[FIG. 3] is a block diagram showing the manufacturing process of the segmented chips.

Regarding the manufacturing of the segmented chips 11, as shown in FIG. 3, grinding layer granular material being a mixture of the super-abrasive grains 14 and the vitrified bond 15 which constitute the grinding layer 12 is filled in press lower molds each with an arc-shape depression to a uniform thickness and is pressed preliminarily with first upper molds, whereby the grinding layers 12 are formed preliminary to the arc-shape. Then, foundation layer granular material including the foundation particles 19 is filled to a uniform thickness on the upper sides of the grinding layer granular materials which have been press-formed preliminarily, and the foundation layer granular material and the grinding layer granular material are simultaneously pressed with second upper molds, whereby the arc-shape segmented chips 11 are press-formed (step 31), in each of which the foundation layer 13 is bodily formed to be piled upon on the inner side of the grinding layer 12. The segmented chips 11 so press-formed are dried and burned (step 32), whereby solid bodies of the segmented chips 11 are completed.

Then, adhesive 20 made of a thermosetting resin is applied to the respective opposite end portions of the segmented chips 11 (step 33), and thereafter, the segmented chips 11 are dried in a drying furnace at an temperature in a range of 50 to 150° C. for a predetermined period of time (step 34), whereby the segmented chips 11 shown in FIG. 2 are completed. Thus, the opposite end portions of each segmented chip 11 are respectively covered with the set adhesives 20, and parts of the adhesives 20 are impregnated into pores of the segmented chip 11 to increase the bonding strength of the segmented chip 11. As a result, the resin layers made of the adhesive 20 are formed at the opposite end portions of each segmented chip 11, and the retention force of the super-abrasive grains 14 which are distributed at the opposite end portions of each segmented chip 11 can be reinforced by the resin layers.

As the case may be, it is possible to form by machining the adhesives (resin layers) 20 which have been adhered to the opposite end portions of each segmented chip 11, to a predetermined shape (predetermined dimension).

Figure 4:
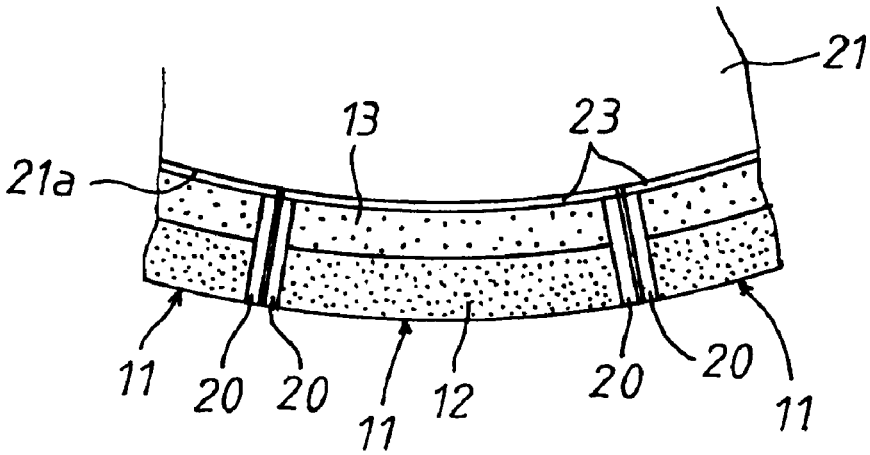
[FIG. 4] is an enlarged fragmentary view of the part A in FIG. 1.

Adhesive 23 (refer to FIG. 4) made of a thermosetting resin is applied to the internal surfaces of the plurality of segmented chips 11 manufactured in this manner, and in this state, the plurality of segmented chips 11 are arranged on the circumferential surface 21*a* of the disc-like core 21 at predetermined intervals in the circumferential direction and are adhered thereto. The segmented grinding wheel 10 with the predetermined number of segmented chips 11 adhered in the circumferential direction is dried in a drying furnace, and this results in setting the adhesives 23 interposed between the circumferential surface 21*a* of the disc-like core 21 and the inner surfaces of the segmented chips 11. Consequently, the segmented chips 11 are firmly bonded on the circumferential surface 21*a* of the disc-like core 21 to complete the segmented grinding wheel 10.

In this case, the segmented chips 11 are arranged so that the clearance between facing end portions of adjoining segment chips 11, that is, between the adhered portions with the adhesives 20 bonded thereto is set to be as small as possible (preferably, to the clearance of 0.5 millimeters or smaller).

As mentioned above, the segmented chips 11 are not given an adhesive effect or strength at the respective opposite end adhesive portions thereof, and thus, the adjoining segmented chips 11 are adhered to the disc-like core 21 without being jointed with each other. Accordingly, each segmented chip 11 can be left to be displaced freely in a radial direction with the expansion and contraction of the disc-like core 21, and therefore, it does not occur that a compression stress or the like is exerted on the adhesive portions at the opposite ends of each segmented chip 11 in spite of the expansion and contraction of the disc-like core 21.

In the segmented grinding wheel 10 of the aforementioned construction, prior to adhering the segmented chips 11 to the circumferential surface 21*a* of the disc-like core 21, the adhesives 20 are applied to respective opposite ends of the segmented chips 11, and then, the segmented chips 11 are supplied with heat to set the adhesives 20 and is returned to the normal temperature. Accordingly, on the contrary to the prior art, it is unnecessary to set the adhesives which have been applied to fill the respective clearances between the segmented chips 11, by applying heat in adhering the segmented chips 11 to the circumferential surfaces 21*a* of the disc-like core 21. Thus, it can be prevented that a compression stress is exerted on the set adhesives when the segmented grinding wheel 10 in the process of manufacturing is returned to the normal temperature after the setting of the adhesives. Therefore, it does not occur that an unnatural force is exerted on the segmented chips 11 adhered to the circumferential surfaces 21*a* of the disc-like core 21.

In addition, a problem has arisen heretofore in that where clearances exist between the segmented chips 11 arranged in the circumferential direction, the grinding operation causes the abrasive grains being situated at the end portion edges of each segmented chip 11 to be burdened with an excess load and hence, to fall off easily, so that the end portion edges of each segmented chip 11 are liable to lose their exact shapes (to wear). Another problem has also arisen heretofore in that the super-abrasive grains 14 distributed at the end portions of each segmented chip 11 are weak in retention force and are easy to fall off. In the segmented grinding wheel 10, however, because the both end portions of each segmented chip 11 are reinforced with the adhesives 20, the end portion edges of each segmented chip 11 become hard to lose their exact shapes through grinding operations in spite of the clearances provided between the segmented chips 11, so that an improvement can be made in the retention force of the super-abrasive grains 14 which are distributed at the end portions of each segmented chip 11.

The foregoing embodiment has been described regarding an example that the segmented chips 11 each reinforced with the adhesives 20 at the opposite end portions are arranged not to have a substantial clearance between the adjoining segmented chips 11. On the contrary, it is possible that the adjoining segmented chips 11 are arranged to deliberately widen the interval therebetween. Even in the form like this, there can be attained an advantage that suppressions can be achieved not only in the falling-off of the abrasive grains at the opposite end portions of each segmented chip 11, but also in the wear at the opposite end edge portions.

Although the foregoing embodiment has been described regarding an example that each segmented chip 11 is constituted by a bilayer structure composed of the grinding layer and the foundation layer, each segmented chip 11 may not necessarily be required to take such a bilayer structure and instead, may take a single layer of the grinding layer only.

INDUSTRIAL APPLICABILITY

The segmented grinding wheel and the manufacturing method therefor according to the present invention are suitable for use in a form that a plurality of segmented chips having super-abrasive grains such as CBN abrasive grains or the like bonded with a vitrified bond or the like are adhered to the circumferential surface of a disc-like core.

The invention claimed is:

1. A segmented grinding wheel comprising:

a plurality of segmented chips, each configured by bonding abrasive grains with a bond and adhered to the circumferential surface of a disc-like core, wherein each of said segmented chips has circumferentially opposite end surfaces, wherein the plurality of segmented chips are each reinforced by an adhesive layer made of a thermosetting resin applied onto said circumferentially opposite end surfaces thereof, and wherein the segmented chips adjoining in a circumferential direction are adhered to the circumferential surface of the disc-like core, with the adhesives at the circumferentially opposite end surfaces of adjoining segmented chips being not bonded with each other.

2. The segmented grinding wheel as set forth in claim 1, wherein the bond is made of a vitrified bond.

3. The segmented grinding wheel as set forth in claim 1, wherein each of the segmented chips is spaced from the segmented chips next thereto at opposite sides in the circumferential direction.

4. The segmented grinding wheel as set forth in claim 3, wherein a clearance provided between each segmented chip and the next thereto in the circumferential direction is set to 0.5 millimeters or smaller.

5. The segmented grinding wheel as set forth in claim 1, wherein each of the segmented chips takes a bilayer structure which is composed of a grinding layer constituted by bonding super-abrasive grains with a vitrified bond and a foundation layer constituted by bonding foundation particles with the vitrified bond and bodily piled up on the inner side of the grinding layer.

6. A method for manufacturing a segmented grinding wheel of a construction that a plurality of segmented chips, each configured by bonding abrasive grains with a bond, are adhered to the circumferential surface of a disc-like core, whereby each of said segmented chips has circumferentially opposite end surfaces, the method comprising the steps of:

filling a mold with granular material including abrasive grains;

performing press-forming and burning to form a plurality of segmented chips;

applying an adhesive layer made of a thermosetting resin onto said circumferentially opposite end surfaces of the segmented chips;

after setting the adhesives at the circumferentially opposite end surfaces, adhering the plurality of segmented chips to the circumferential surface of the disc-like core by arranging the plurality of segmented chips on the circumferential surface of the disc-like core at regular intervals with a clearance between each segmented chip and the next thereto in the circumferential direction.

7. The method as set forth in Claim 6, wherein the clearance is 0.5 millimeter or smaller.

8. The method as set forth in claim 6, wherein the step of adhering the plurality of segmented chips to the circumferential surface of the disc-like core is performed by drying adhesive applied between the segmented chips and the disc-like core, without applying heat.

* * * * *